US005584487A

United States Patent [19]

Blue

[11] Patent Number: 5,584,487

[45] Date of Patent: Dec. 17, 1996

[54] NO BOUNCE NO DUNK AIR BALL RECREATION GAME

[76] Inventor: John D. Blue, P.O. Box 1992, Tarpon Springs, Fla. 34688-1992

[21] Appl. No.: 655,881

[22] Filed: May 31, 1996

[51] Int. Cl.[6] ..... A63B 67/00

[52] U.S. Cl. ..... 273/411; 273/1.5 R

[58] Field of Search ..... 273/411, 1.5 RA, 273/395, 396, 398, 400, 401, 402

[56] References Cited

U.S. PATENT DOCUMENTS

| | | | |
|---|---|---|---|
| 3,201,126 | 8/1965 | Nissen | 273/402 X |
| 3,602,505 | 8/1971 | Friend | 273/411 X |
| 3,671,040 | 6/1972 | Meyer et al. | 273/342 X |
| 3,817,520 | 6/1974 | Burgos | 273/411 X |
| 3,908,992 | 9/1975 | Cunningham et al. | 273/55 D |
| 3,908,994 | 9/1975 | Astrom | 273/61 R |
| 3,968,968 | 7/1976 | Peterson | 273/411 |
| 4,047,717 | 9/1977 | Deangelis | 273/411 X |
| 4,415,154 | 11/1983 | Engelhardt | 273/60 R X |
| 4,457,513 | 7/1984 | Thompson | 273/411 |
| 4,482,157 | 11/1984 | McNeil | 273/411 |
| 4,497,492 | 2/1985 | Lehman, Jr. et al. | 273/411 |
| 4,523,762 | 6/1985 | Garner, Sr. | 273/411 |
| 4,762,319 | 8/1988 | Krumholz | 273/402 X |
| 4,807,879 | 2/1989 | Eliot | 273/29 A |
| 4,844,478 | 7/1989 | Kessler | 273/411 |
| 4,874,169 | 10/1989 | Litchfield | 273/60 R |
| 5,072,947 | 12/1991 | Blue | 273/371 |
| 5,106,101 | 4/1992 | McKay | 273/411 |

*Primary Examiner*—William H. Grieb

[57] ABSTRACT

A competitive recreational game including: a foam game ball with symmetrical air holes throughout; a ball striking instrument selected from a choice of a racquet, a paddle or a pair of hand fitted foam mitts; an apparatus frame consisting of bases for a flat surface or pointed posts sections for outdoor sand or earth use; two sectional posts; a basketball style backboard with two basketball style hoops and nets attached thereon; scoring rules and regulations for all levels of play based on at least 1 opposing player. Optionally, the game may consist of a basketball style hoop and attached net with a support frame means. All the game component frame parts are made of outdoor furniture P.V.C. pipe and fittings. A carryall gym style bag is supplied to accept all the component parts for easy transporting to the beach or a picnic or the like.

15 Claims, 14 Drawing Sheets

NO BOUNCE NO DUNK AIR BALL RECREATION GAME

BACKGROUND OF THE INVENTION

This invention relates generally and is a continuation of the same apparatus of U.S. Pat. No. 5,072,947 granted on Dec. 17, 1991 to JOHN D. BLUE and a co-pending application.

1. Field of the Invention

This invention relates generally to a game apparatus with a foam air ball which is hit back and forth across a support net on posts with a basketball hoop and net on a backboard. Two opposed players make the game functional.

2. Prior Art Description

Competitive games of various types are numerous such as badminton, tennis and racquetball. Prior Pats. such as U.S. Pat. Nos. 3,968,968; 4,457,513; 4,844,478; 3,908,994; 3,817,520; 4,523,762; 4,415,154; 4,047,717; 4,807,879; 4,874,169; 4,497,492; 3,671,040 are hereby cited.

After careful review of the aforementioned prior art it becomes evident that a variety of improvements are needed to overcome the game disadvantages which leave room for a simple to assemble and use consume model that is easy to disassemble and carry around.

SUMMARY OF THE INVENTION

The present invention relates to a recreational scoring game. The novel foam ball has holes punched or drilled throughout the entire playing ball in a symmetrical manner which yields an AIR drag so as to limit the hitting distance and not be a weapon such as the ball in racquetball can be. This foam ball is easy to control,see and play for two opposed players. The complete frame of the game is made of P.V.C. outdoor furniture pipe that will not yellow in sun light.

The game of the invention is designed for home use either in or out-doors. It can easily be assemblied and played anywhere as the parts haw a choice of a flat style base support for concrete or flat surfaces and a pointed bottom post for sandy beaches or backyards.

Each of the component parts are cut and designed to fit into a carryall gym bag with assembly instructions. The game has two hoop/net assemblies to choose from. Scoring points is easy. The ball can not touch the ground. A NO BOUNCE rule. You can also NOT dunk the ball. The ball must be contacted with one of a choice of ball striking instruments; a racquet, a paddle or a pair of foam mitts.

The invented game has no boundries such as in tennis. The game is approximately 4 to 5 feet wide and approximately 5 feet high when all 3 sections of the post are placed together in sequence. One or even two sections of the posts may be removed so as to lower the game for children to play.

To start the game one player hits the game ball to the opposed player which starts a volley with either player trying to hit and place the ball into a hoop/net assembly thereby scoring a point. The player serving receives a point if the opposed player misses the ball and the ball hits the ground. The first player to receive 15 points wins the game. A missed to ground ball is one point while a hoop/net ball is two points. In the preferred 2 hoop/net assemblies and common to both sides backboard the person that places the game ball into their opponents hoop/net wins the game automatically. The ball goes from one side,over the common backboard and into the opposite hoop/net assembly. This is very difficult to execute and well worth the point to automatically win the game.

At no time can the game ball be blocked or dunked. The ball has to be contacted by a ball striking instrument and hit across the virtical net.

The balance of the features and advantages of the present invention will be apparent during the course of the following drawings and preferred embodiment descriptions.

(A) is a flat top view of a racquet with strings and a handle.

(B) is a flat top view of a wooden paddle with a handle.

(C) is a flat top view of a pair of foam mitts.

Figure 8A:
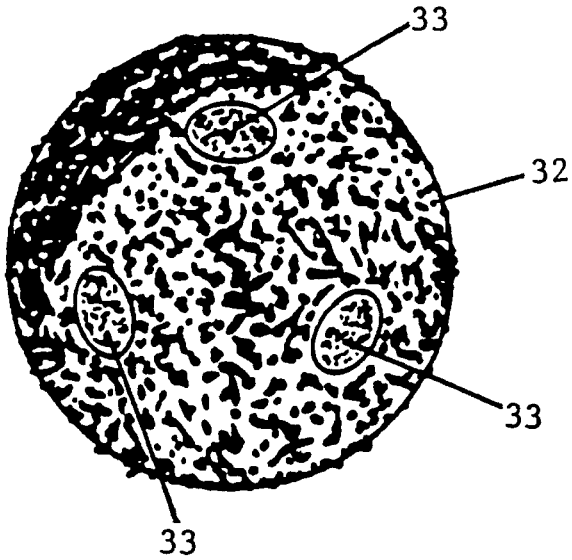

FIG. 8 (A) is a perspective view of the ball for the recreation game.

(B) is a front view, of one side, of the ball for the recreation game.

(C) is a cross sectional view of the ball for the recreation game.

Figure 9:
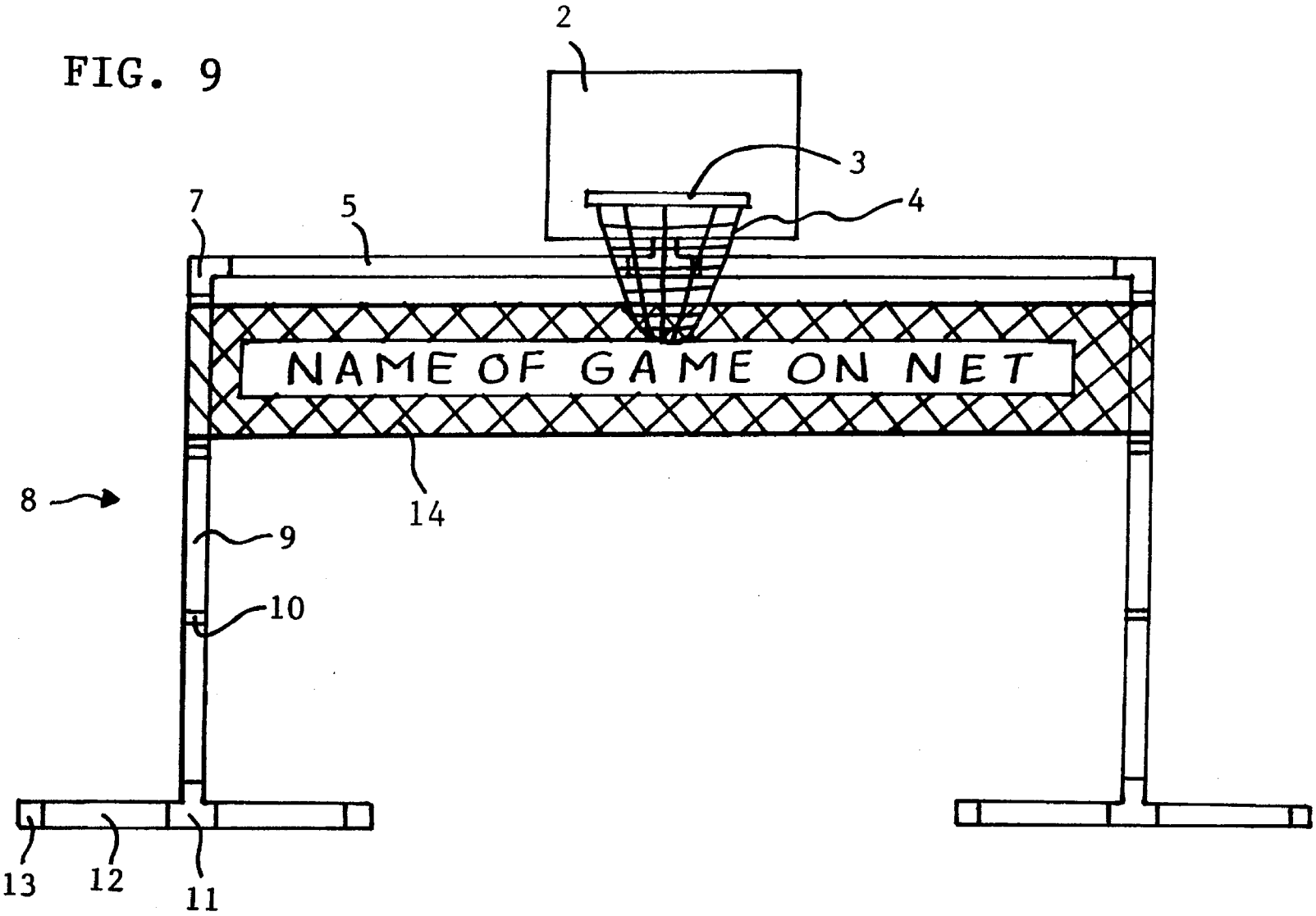

FIG. 9 is a front view, of one side of the recreation ball game showing a hoop/net assembly and 1 common to both sides backboard; the opposite side view being the mirror image.

Figure 10:
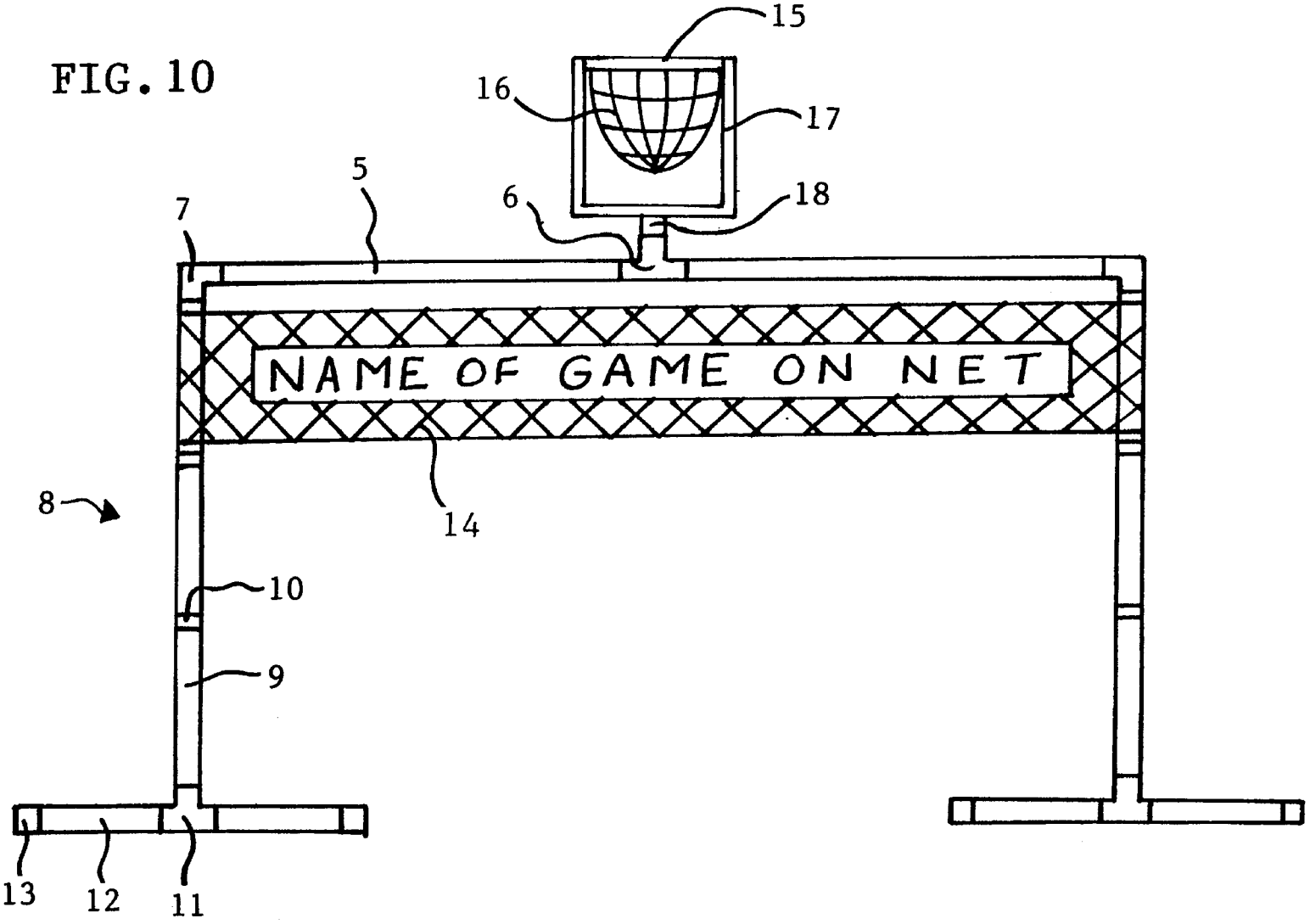

FIG. 10 is a front view, of one side of the recreation ball game showing the optional 1 hoop/net assembly with support frame means common to both sides; the opposite side view being the mirror image.

Figure 11:
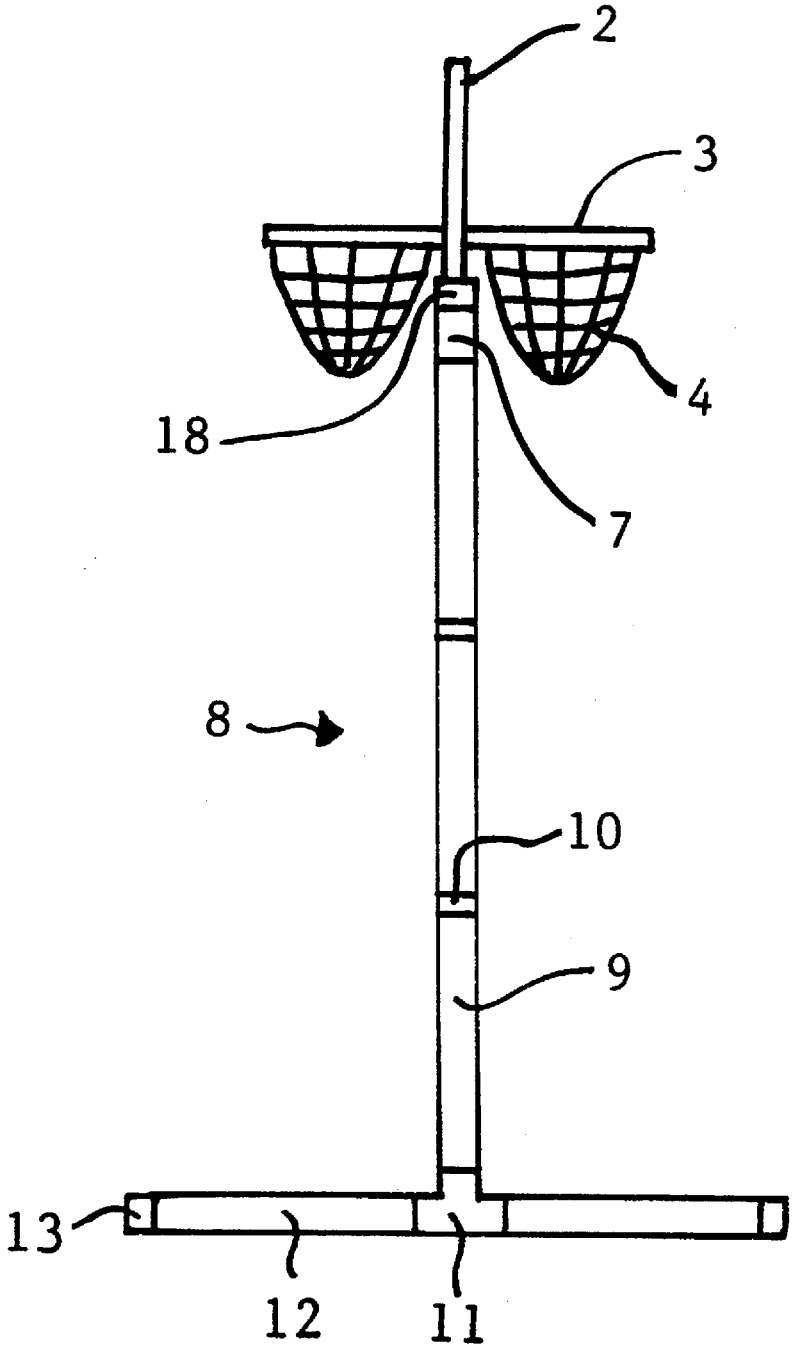

FIG. 11 is an end view of the recreation ball game showing 2 hoop/net assemblies and 1 common to both sides backboard; the opposite end view being the mirror image.

Figure 12:
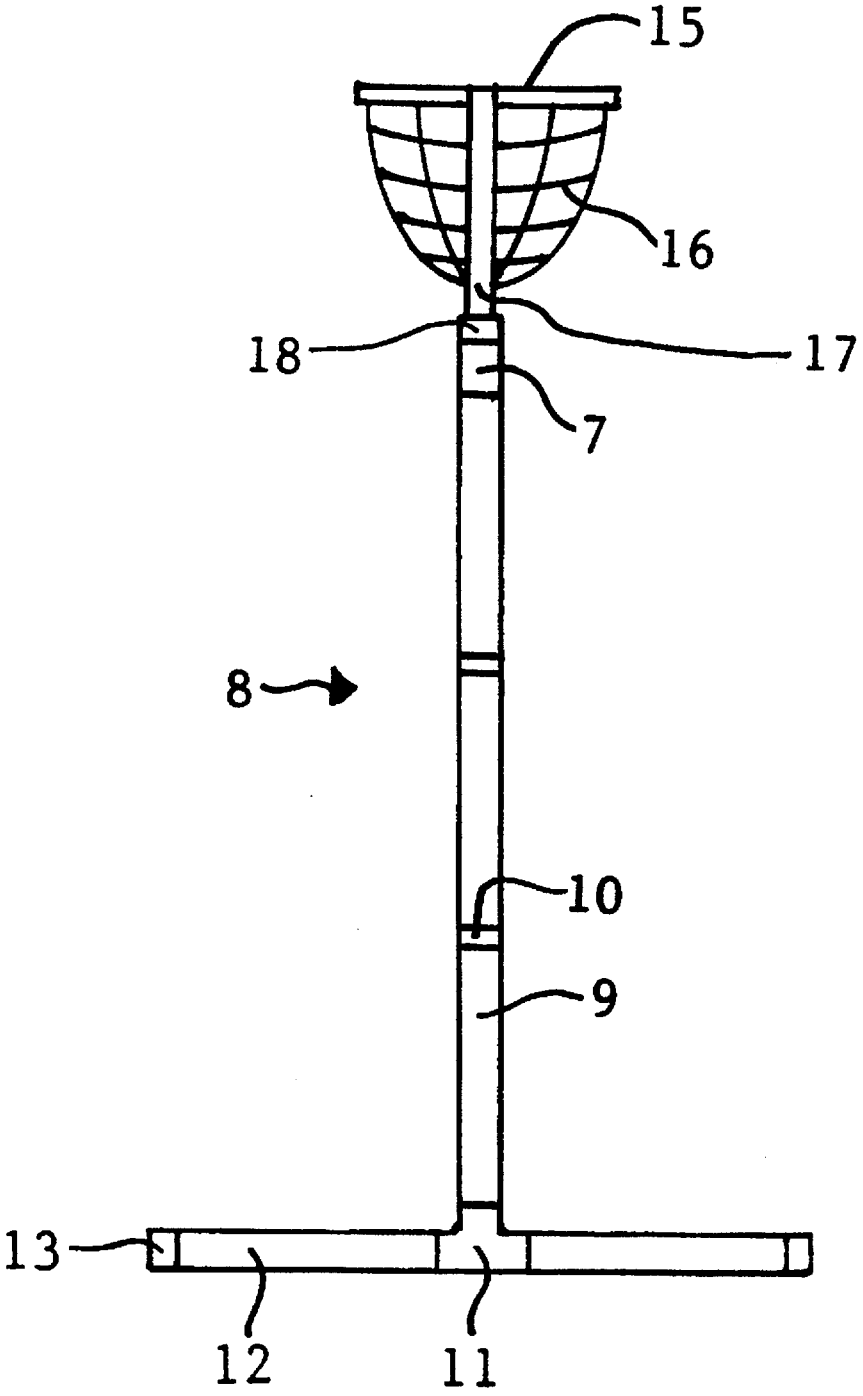

FIG. 12 is an end view of the recreation ball game showing the optional hoop/net assembly with support means; the opposite end view being the mirror image.

Figure 13:
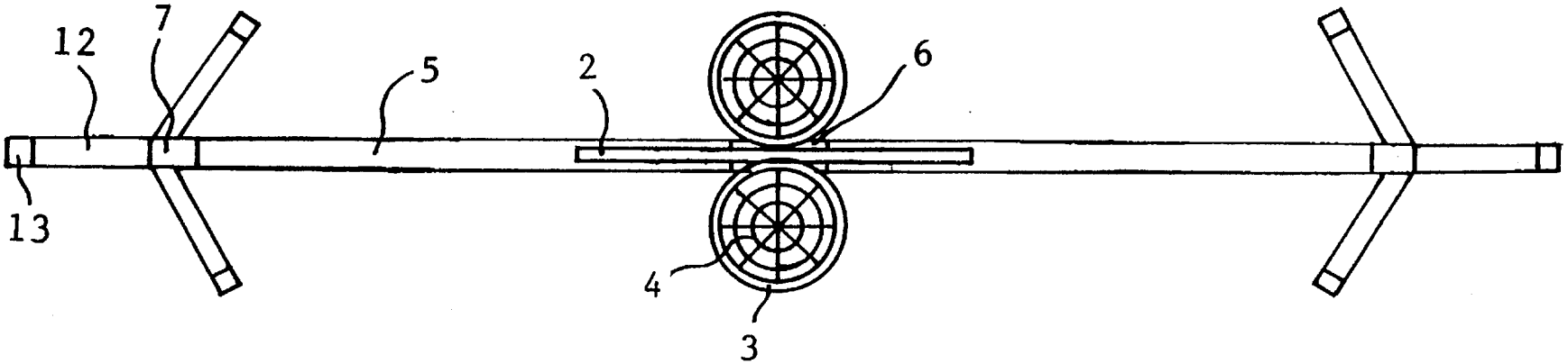

FIG. 13 is a top plan view of the recreational ball game showing 2 hoop/net assemblies with a common to both sides backboard.

Figure 14:
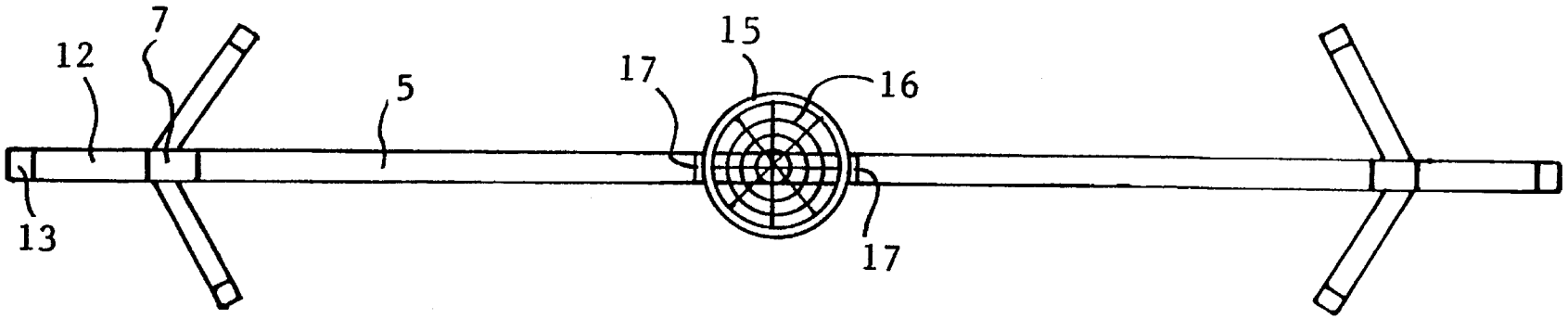

FIG. 14 is a top plan view of the recreation ball game showing the optional 1 hoop/net assembly with support means frame common to both sides.

DESCRIPTION OF THE PREFERRED EMBODIMENT

Figure 1:
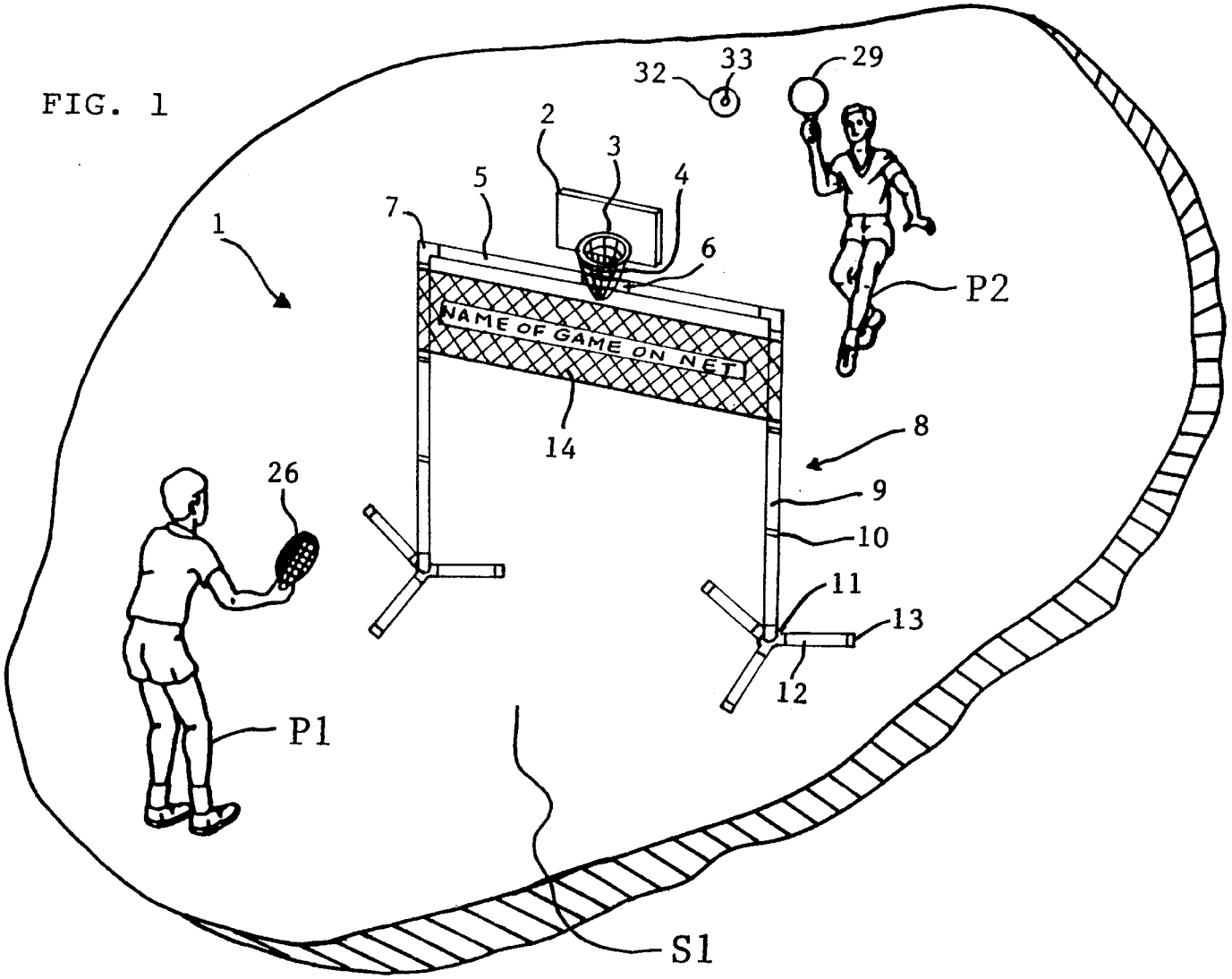
FIG. 1 is a pictorial perspective view of the recreation ball game with hoop/net assemblies on a common to both sides backboard.

Referring now to the drawings, and especially to FIG. 1 thereof, a game of the invention is illustrated generally at 1 showing two opposed players P1 and P2 on surface S1 hitting game ball 32 with holes 33 towards a backboard 2 with attached hoop 3 and net 4 which is supported and attached to horizontal pipe section support means 5 with P.V.C. tee fittings 6. At each end of support means 5 are elbow P.V.C. fittings 7 which interconnect to the top of posts 8 and to each end of the horizontal support means 5. Each general post 8 has three P.V.C. pipe sections 9 which interconnect by inside coupling 10. At the botto of each post 8 is a P.V.C. three way tee 11 with three attached P.V.C. horizontal legs 12 and three attached P.V.C. caps 13. The caps may be replaced with plugs. Attached to the top section of post 8 is a virtical net 14. This net 14 can be made of a nylon web such as in the game of badminton. The preferred material is the covering material as used to cover the cushions in the outdoor furniture business. The net is cut to fit by wrapping it around the top pipe section 9 and is sewn back to itself thereby forming a loop eye tube which when sewn together slips over the top pipe section 9 of post 8 and slides down to rest on the top of the upper inside coupling 10. The horizontal support means is cut to fit tight thereafter the net 14 fits snugly when in place and will not slide down the post section 9 past the coupling 10. The net 14 offers a surface for advertising the name of the game:

AIR BALL

Figure 2:
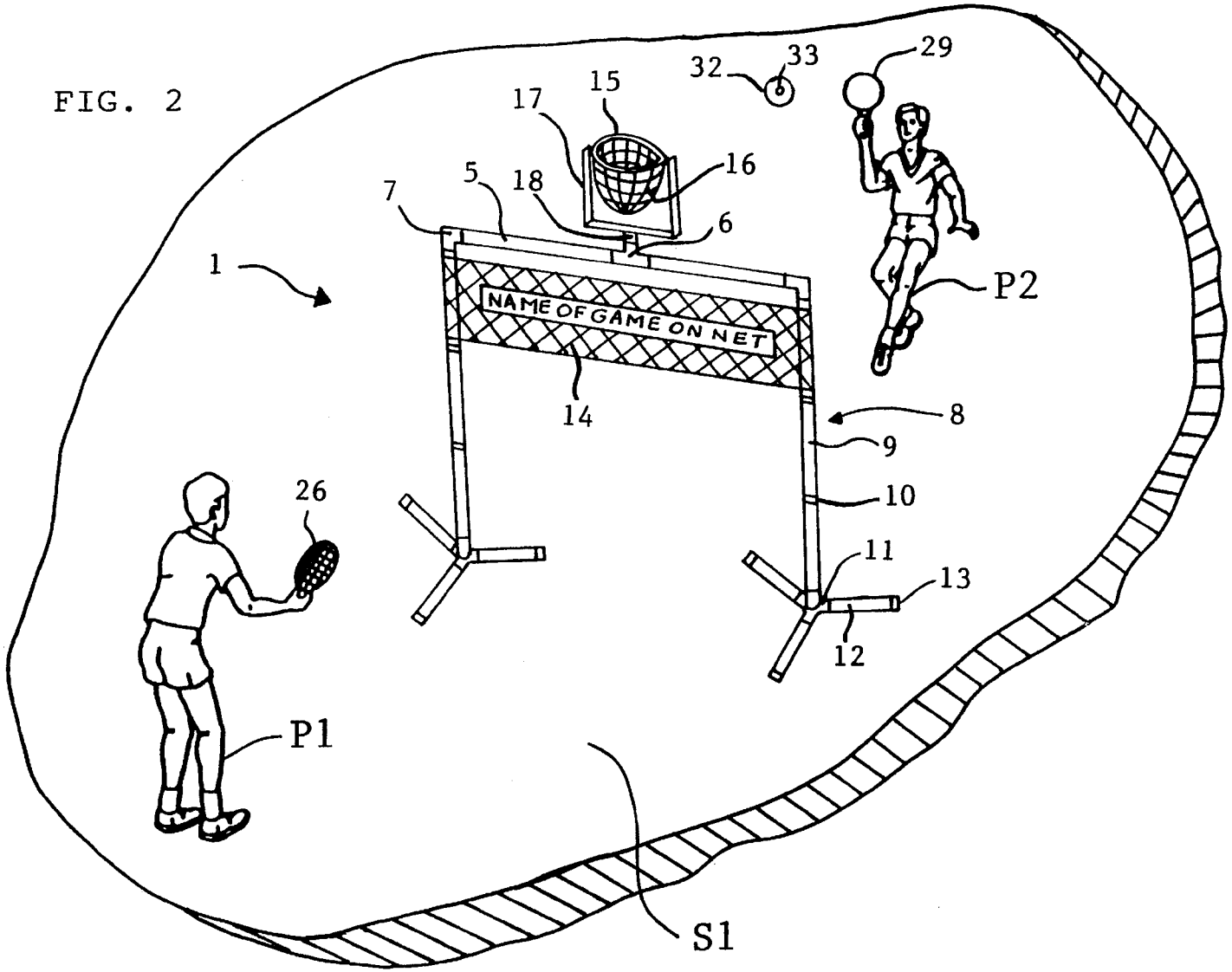
FIG. 2 is a pictorial perspective view of the recreation ball game with an optional hoop/net assembly common to both sides.

In FIG. 2 a game of the invention is illustrated generally at 1 with players P1 and P2 on surface S1 hitting the game ball 32 with hole 33 therethrough. FIG. 2 shows the same configuration of the various component parts as FIG. 1. In this view the optional hoop 15 with option al net 16 is attached to optional hoop/net support means 17 which is attached to support cap 18 which is attached to P.V.C. tee fitting 6.

The game of the invention has the following component parts;

PREFERRED LIST 6 pipe post sections;

4 inside couplings;

1 tee fitting;

2 elbow fittings;

2 horizontal pipe sections;

1 virtical game net;

2 three way tee fittings;

6 leg pipe sections;

6 leg cap fittings;

1 basketball backboard;

2 basketball hoops;

2 basketball nets;

1 support cap fitting;

1 pipe nipple;

2 bolt/washer/nut combinations;

OPTIONAL LIST 1 basketball hoop; common to both sides;

1 basketball net; common to both sides;

1 optional hoop/net support frame;and 2 pointed post pipe sections for outdoor use.

Figure 3:
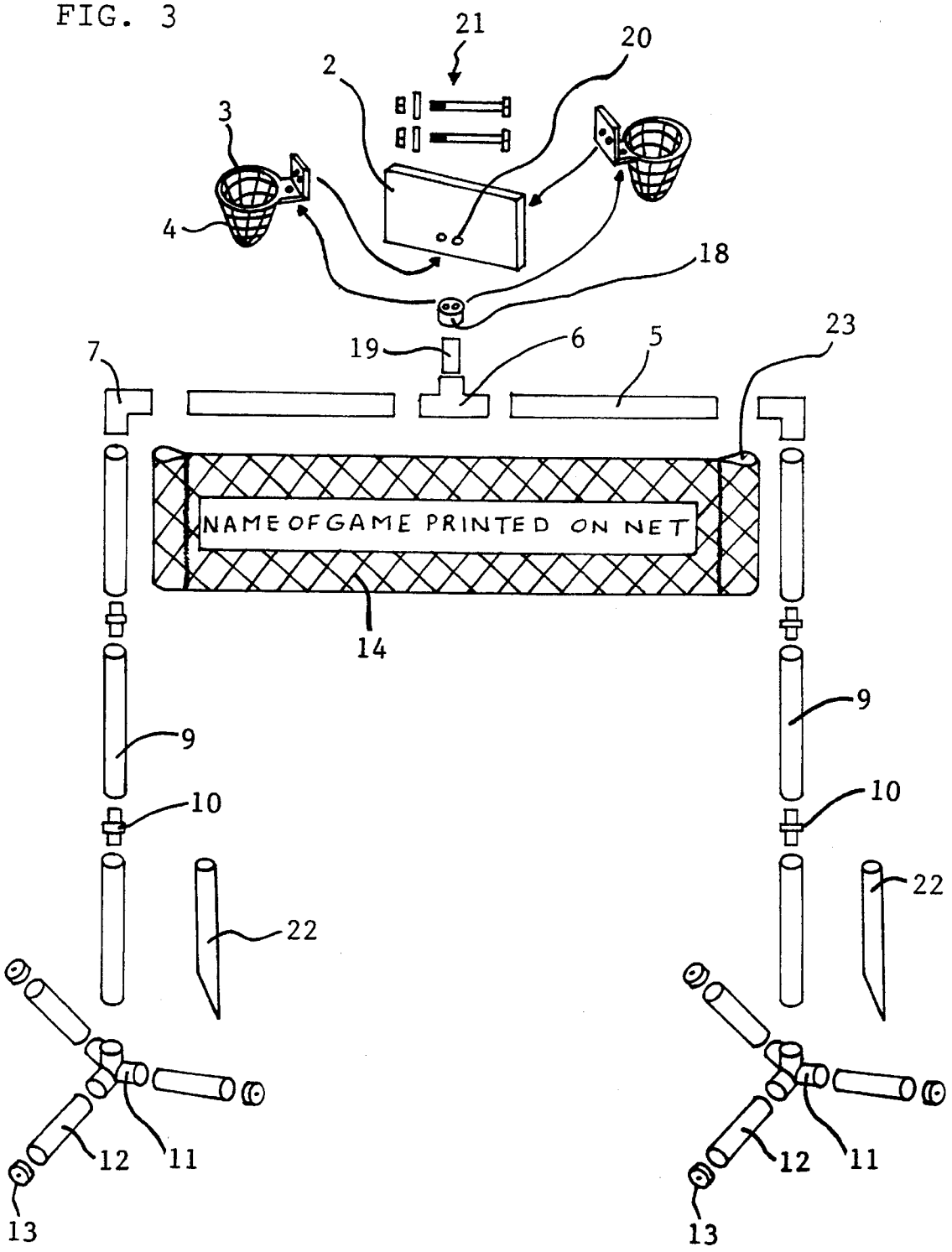
FIG. 3 is a component parts flat view of the recreation ball game with 2 hoop/net assemblies and 1 common backboard.

These component parts are better displayed in FIG. 3 with a flat drawing of the game of the invention. Starting in the lower left hand hand corner there are three caps 13 with legs 12 and a three way tee 11. A pointed post section 22 is shown for outdoor use. Three post sections 9 are shown with two inside couplings 10. At the top left hand corner is an elbow 7 with horizontal pipe section 5; a tee fitting 6; a pipe nipple 19; a cap fitting 13; a basketball backboard 2 with two attachment holes 20 for two basketball hoops 3 and two basketball nets 4. Two bolt, washer, nut combinations 22 are displayed as the attachment means for the hoop 3 net 4 combination to the backboard 2.

Starting to the right of the tee 6 is another horizontal pipe section 5 with the right hand corner elbow 7; three virtical pipe sections 9 with two inside couplings 10 and the right side optional pointed post section 22. The post support consists of three pipe legs 12; three cap fittings 13 and one three way tee 11.

Figure 6:
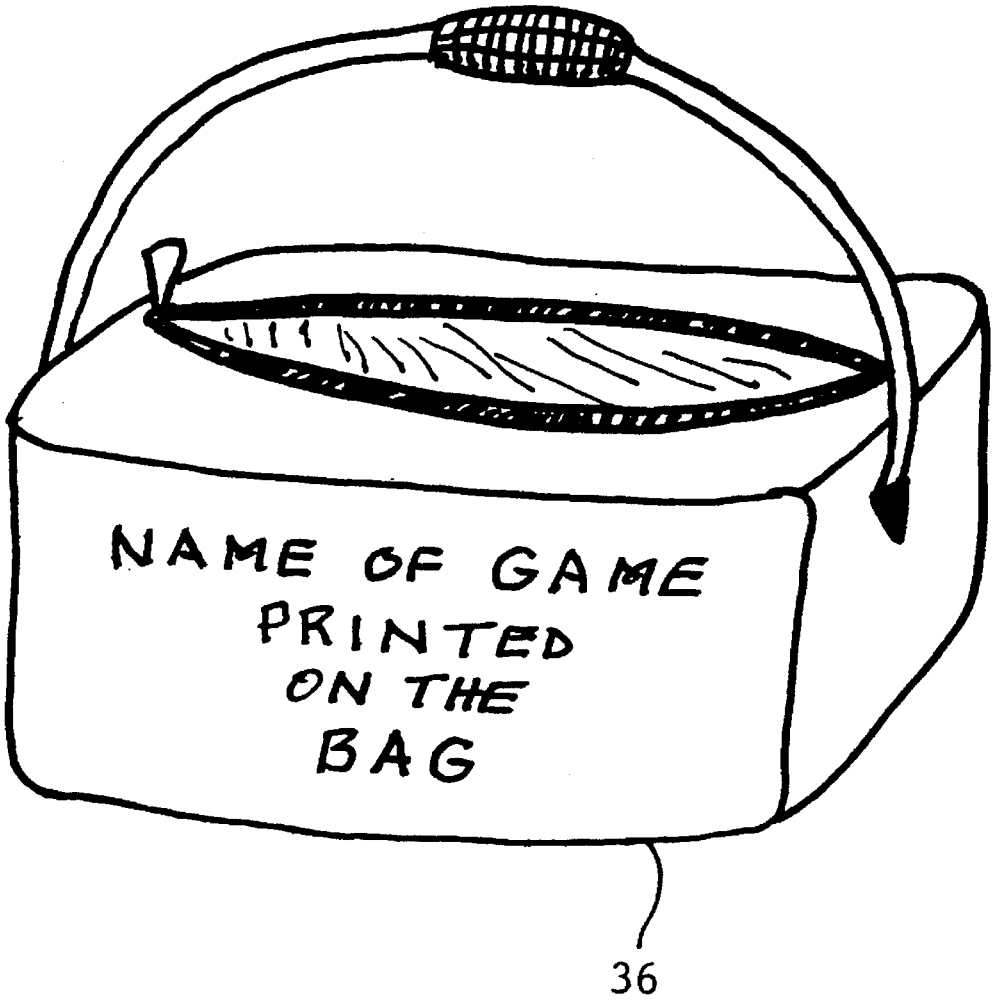
FIG. 6 is a perspective view of the carryall gym bag for the component parts of the recreation game.

In assembling the game of the invention all the component parts are cut to fit and NOT glued together. These component parts are placed in a carryall gym bag as seen in FIG. 6.

The only parts that may be glued together are:

glue all caps 13 (or plugs) to the legs 12.

glue two legs 12 to the three way tee 11.

This leaves one leg with cap free to place in the carryall bag. The glued section with two legs and the three way tee also can fit in the bag easily.

glue a post pipe section 9 and an inside pipe coupling 10 together.

This gives you 3 sections to each post. The smaller parts stay glued in place and can not be misplaced as easy.

glue one elbow 7 to one horizontal pipe section 5.

glue this section to one end of the tee 6 with the tee 6 pointing up to meet the nipple 19 and the upper basketball assembly.

glue the other elbow 7 to the other horizontal pipe section 5.

do not glue this section to the opposite end of the tee 6.

This yields two sections for the horizontal support means. Both will fit in the carryall bag. Both can be hand pressure fit together and disassemblied. Glued together they will not fit into the gym bag. The virtical net 14 is cut in length to fit then sewn to form a loop 23 at each end which fits over the top pipe section 9.

The game of the invention comes disassemblied in a carryall gym bag. All the frame component parts are made and cut of sturdy outdoor P.V.C. furniture pipe and the fittings thereof which will not turn yellow in the sunlight. All fittings and pipe are easily assemblied for indoor and outdoor use. The leg assembly is for a flat surface such as a floor, a driveway or the like. The pointed section of the post is for outdoor use such as a backyard or sandy beach.

In either case a complete post section may be left out which lower the game down to a level for children.

Figure 4:
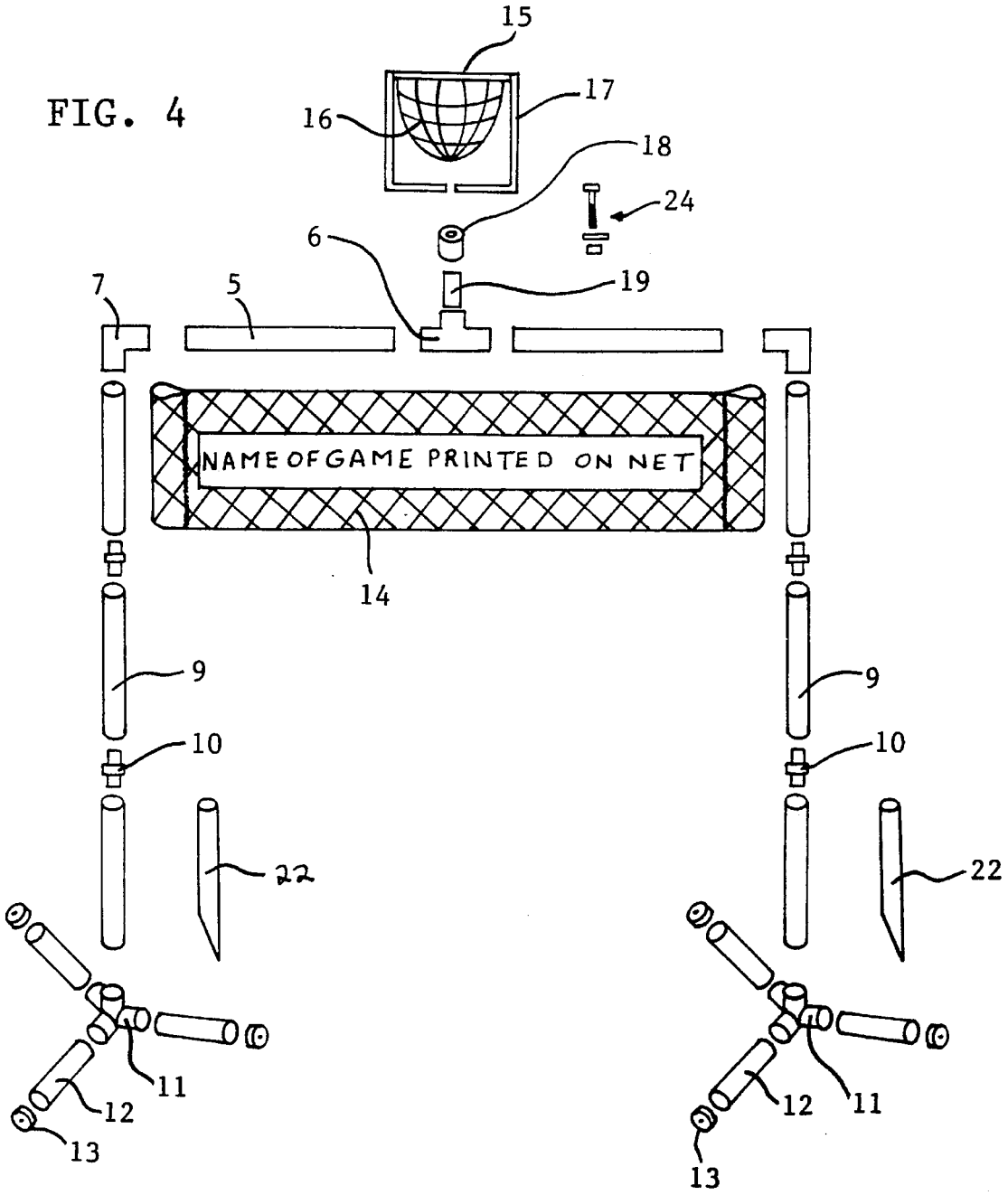
FIG. 4 is a component parts flat view of the recreation ball game with the optional 1 hoop/net assembly common to both sides.

In FIG. 4 everything is the same as FIG. 3 accept the optional basketball assembly. An optional hoop 14 with optional net 15 and optional hoop/net support means 17 is shown with support cap 18 and a single optional bolt, washer, nut attachment means 24.

In this option the bottom of the hoop/net support means 17 has a hole wherein optional attachment means 24 is placed therethrough into support cap 18. This makes for easy off/on attachment.

The reason for the two seperate basketball hoop/net assemblies is the degree of difficulty. The optional common to both sides hoop/net assembly makes it easy for either opposed players to place the game ball in to said assembly for a point. The preferred hoops/nets/common backboard increases the difficulty factor. Also this model is more expensive to produce.

Figure 5:
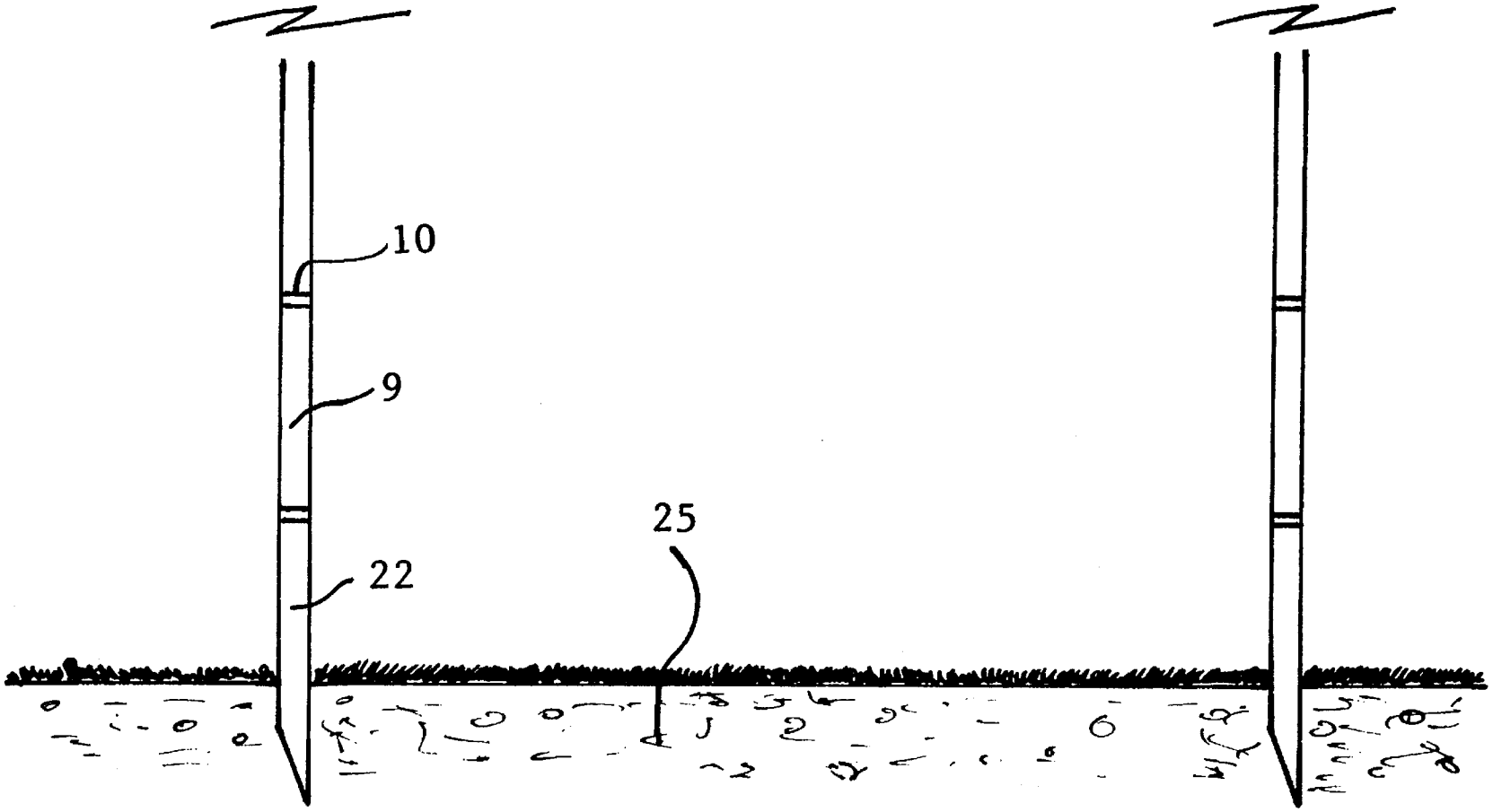
FIG. 5 is a flat elevation view of the outdoor posts embedded in the earth.

FIG. 5 is a front elevation view of the two posts 8 with attached inside couplings 10 embedded in the earth.

FIG. 6 is a perspective view of the carryall gym bag 36 for the game of the invention.

Figure 7A:
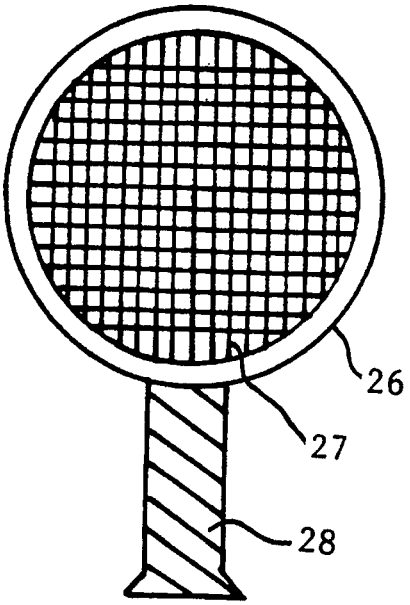
FIG. 7 is a selection of the ball striking instruments as follows.
Figure 7B:
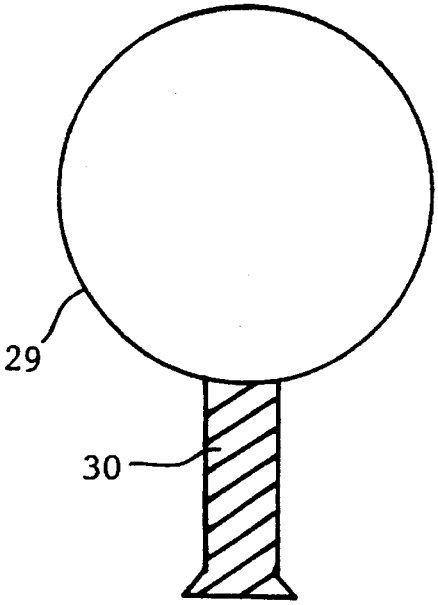
Figure 7C:
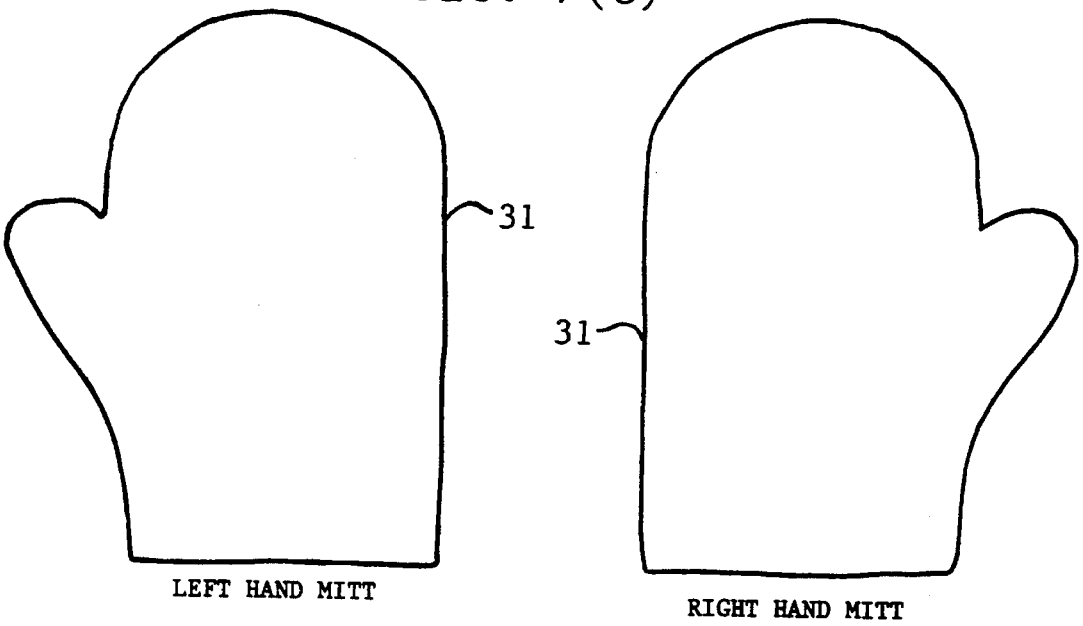

FIG. 7 (A) is a flat view of one of the selection of the ball striking instruments, a racquet 26 with strings 27 and handle 28. FIG. 7(B) is a flat top view of another ball striking instrument, a wooden paddle 29 with handle 30. FIG. 7(C) is a flat view of a pair of foam mitts 31.

If a paddle or racquet is selected to play the game of the invention only one is needed per player. Two of each could be used. In the case of the mitts; one on each hand makes the game interesting.

The game of the invention has simple rules with no court boundary lines. The no bounce, no dunk rule applies. The ball is hit back and forth until one player misses the ball whereby earning a point for either side depending on who served. A point is scored when the ball is hit and placed into the hoop/net assembly. In the preferred game a common to both sides backboard offers the option of hitting the game ball off the backboard and into the hoop/net assembly.

Turning now to FIG. 8 (A) shows the game ball 32 made of foam with a plurality of holes 33 cut by punching or drilling into and throughout the ball 32, from one surface to the opposite surface. The preferred combination is three identical holes 33 geographically located at equal starting entrance 34 while passing entirely through ball 32.

Figure 8B:
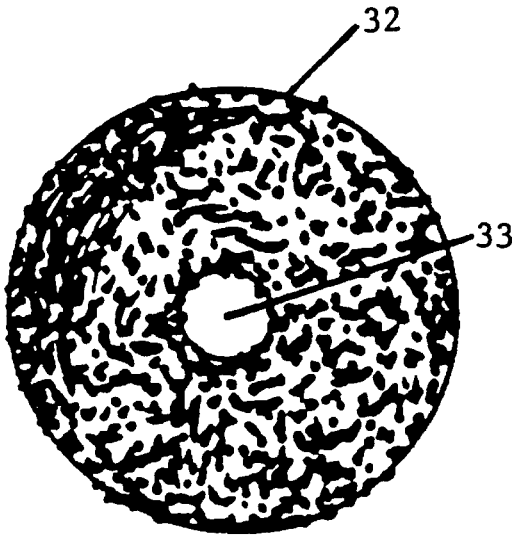

Further FIG. 8(B) shows the game ball 32 in a side view with holes 33.

Figure 8C:
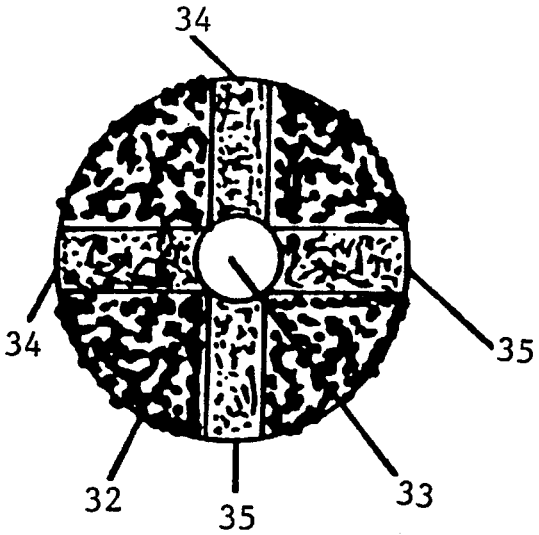

FIG. 8(C) shows the game ball 32 with entrances 34 and exits 35 with hole 33. This center hole 33 is intersected by the cut hole channels entering at 34 and exiting at 35. This view reveals three holes 33 in ball 32.

The game ball 32 is made with a spherical aerodynamic designed shape After several experiments the preferred combination is three identical holes 33 geographically located at equal starting entrance 34 positions while passing entirely through ball 32 to exit point 35 on the opposite surface. Each hole 33 is preferred round in shape.

The amount of the foam ball 32 material removed may range from 5% to 40% by weight/volume. Preferred is approximately 20% by weight/volume removed from said ball 32. If any less, the ball 32 has less air drag. If any more,the ball 32 will collapse, making the ball 32 unplayable. Twenty percent removed yields a stable playable ball 32 with just enough air drag to limit the distance for playability in the game 1 of the invention.

The ball 32 is manufactured from a polyurethane open cell foam. Preferred is polyether which passes the U.S.A. Federal Safe Toy Act.

The preferred ball 32 diameter is four inches. The right size to handle while fitting through most basketball hoop/net assemblies. The pore size of the ball 32 may range from 10 to 100 p.p.i.'s (pores per inch). Preferred is approximately 50 p.p.i.'s. The color of ball 32 may range from a white to black spectrum.

Further turning to FIG. 9 a frontal view of the game of the invention is shown with cap fittings 13 pipe legs 12 connected to three way tee fitting 11 which supports post 8 with interconnecting inside coupling fittings 10. The top section of post 8 has a virtical net 14 suspended across the horizontal width of the game. At each upper corner are elbow fittings 7 which interconnect the horizontal pipe support means 5. Said support means is attached to a centrally located tee fitting 6. Said fitting 6 is the support means for the common to both sides backboard 2 with attached hoop 3 and net 4. This preferred model has another hoop/net assembly on the blind side. The opposite side of FIG. 9 is the mirror image.

FIG. 10 is the same view as FIG. 9. In this view the optional common to both sides hoop 15 with attached optional net 16 is shown supported by frame means 17. The tee fitting 6 has a support cap fitting 18. This arrangement is interconnected to the horizontal pipe support means 5. The balance of the component parts are the same as FIG. 9.

FIG. 11 is an end view of the preferred model of the invention with cap fittings 13, pipe legs 12, three way tee fitting 11 which support post 8 with pipe section 9 and inside coupling fittings 10. An elbow fitting 7 is shown with support cap fitting 18 which supports the common to both sides backboard 2 with attached hoops 3 and nets 4.

FIG. 12 is an end view of the optional common to both sides hoop 15 with attached net 16 with support means 17. The balance of the component parts are the same as FIG. 11.

FIG. 13 is a flat top view of the preferred model of the invention with cap fittings 13 and pipe legs 12 at each end. Elbow fittings 7 are attached to horizontal pipe support means 5 at each end. These sections are interconnected in the middle to tee fitting 6. Backboard 2 is show with opposing hoops 3 and nets 4.

In FIG. 14 the optional common to both sides hoop 15 with attached net 16 and support means 17 is shown in a top flat view. On each side of the hoop 15, net 16 means 17 are the sections of the horizontal support means 5 with elbow fittings 7 and pipe legs 12 with cap fittings 13.

As to the preferred manufactured apparatus of the game 1 of the aforementioned invention with the said ball 32; select the desired foam shape, diameter size with the number of holes 33 and position of holes 33 and manufacture said game 1 ball 32. For the game 1 apparartus select the preferred ball striking instrument a racquet 26, a wood paddle 29 or foam mitts 31 for singles play in combination with a frame style, a post style, a net style, a backboard hoop/net combination and construct the game along with simple rules and regulations and play the game of the invention.

In the case of the inside coupling an option may be an outside coupling. In the case of the base, the preferred is three pipe legs with three cap fittings or three inside plug fittings may be used. Also a four way tee fitting may be used which yields four pipe legs with caps or plugs for better stability. Optional P.V.C. lamp bases may be used.

In the case of the net; there are numerous materials. The best as mentioned earlier is the indoor coverings for the cushion used in outdoor P.V.C. furniture.

In the case of the ball striking instruments the selection may be 2 racquets or 2 paddles. One in each hand. In the case of the mitts the foam is polyester which is heat sealed and dye cut to the correct shape and size; either adult or children.

Further mentioned herein is the arrangement of all component parts. These parts are placed into a carryall gym style bag so the players can transport the game to the beach or to a picnic etc. The game comes with a diagram of all the parts laid out for easy assembly.

It is hereby understood that the aforementioned detailed form of the preferred embodiment of the invention is not to be limited to the exact arrangement but is an example only. The arrangement of the parts shown in the drawings or described in the disclosure may be modified without departing from the true spirit and scope of the invention. The details of the shape, size, materials and function of the game of the invention are of novel concept thereof.

Having thus described the invention with an exclusive property or privilege:

What is claimed is:

1. A competitive recreational ball game assembly in which opposed players return a ball, with no prescribed court playing surface, over an apparatus located therebetween said players, the ball game assembly comprising in combination:

at least one game ball;

at least one ball striking instrument;

and an apparatus, said apparatus comprising;

a frame means having a horizontal supporting means;

a virtical net means;

a plurality of support post means; for in-outdoor use;

a plurality of base support means;

at least one basketball style backboard position common to both sides;

said backboard having a support means to said horizontal support means;

at least one basketball style hoop and attached net assembly on opposing sides of said backboard;

said hoop and net assembly having an attachment means to said backboard;

said hoop and net dimensioned for said ball, driven by said striking instrument, to pass therethrough said basketball assembly said ball game assembly having a carryall gym style bag to accept all component parts of said game said game basketball backboard, hoops and nets being a means for scoring points; and said game having an optional basketball hoop and attached net assembly with a support frame means while having no basketball style backboard.

2. The invention of claim 1 wherein said game ball is made of polyurthane foam having open cells said ball having at least one hole placed therethrough said hole having an entrance and an exit said ball being round in shape.

3. The invention of claim 1 wherein a selection of said ball striking instruments consist of a racquet with strings and a handle, a wooden paddle with a handle or at least one polyurethane foam mitt said mitt formed by heat sealing and dye cutting polyester foam to the desired shape and size.

4. The invention of claim 1 wherein said frame is a support means for at least one basketball style backboard said backboard being a support means for at least one basketball style hoop and net assembly on each opposed side of said backboard said backboard, hoop, net assembly being positioned above said frame.

5. The invention of claim 1 wherein said virtical support means are opposing posts with at least one section with an interconnecting means said means being an inside or outside coupling means.

6. The invention of claim 1 wherein two opposed post sections accept and retain a virtical net means said net thereafter is suspended virtically between said posts.

7. The invention of claim 1 wherein said posts are supported by a base means said base having a plurality of pipe legs horizontally positioned away from said posts for indoor use or on a flat playing surface thereof.

8. The invention of claim 1 wherein said posts have a bottom section wherein said section has one end pointed so as to be pushed into sand, earth or the like thereby being stabilized said posts being for outdoor use.

9. The invention of claim 1 wherein said net is suspended and supported by said opposed post sections said net having a flat surface so as to advertise the name of said game on each opposed surface said net is of a nylon material made from the cushion covering material used in the outdoor furniture business said material being cutable, sewable, mildew resistant, available in a wide spectrum of colors said net having a loop eye formed and sewn back into said net material on opposing ends of said net said loop eye being placed over and slipped downward onto opposed pipe sections of said posts thereby forming a removeable virtical net for said game.

10. The invention of claim 1 wherein said base support means is a plurality of pipe legs which interconnect to a fitting which accepts and receives the bottom end of said post said legs project away form said post in a horizontal position said base with said legs being for indoor use or flat surfaces.

11. The invention of claim 1 wherein said game has at least one common to both sides basketball style backboard with an attachment means for a least one basketball style hoop and net assembly attached to each opposed side of said backboard said backboard being either opaque or transparent said backboard being the shape of a common style basketball backboard or the like said backboard having a support means to said frame assembly said backboard, hoop and net assembly being positioned above said frame assembly said basketball, hoop and net assembly being a means of scoring points in said game.

12. The invention of claim 1 wherein said carryall gym style bag is made of a sturdy material with a zippered compartment with a hand or shoulder strap as a carrying means said compartment being capable of accepting and retaining all the component parts of said invented game.

13. The invention of claim 1 wherein said basketball style hoop and net assembly is an optional NO backboard style assembly consisting of one common to both sides basketball hoop with attached net assembly having a support frame means for said hoop and net assembly said frame assembly being centrally located on and supported by said horizontal support frame means said hoop, net and frame assembly being positioned above said horizontal support means said hoop, net and frame assembly acts as a point scoring means while said assembly is dimensioned for said game ball, driven by said ball striking instrument, to pass there-through said basketball assembly.

14. The invention of game 1 wherein all the component frame parts and support part means are made of P.V.C. outdoor white furniture pipe and the fittings thereof said parts all interconnect by hand pressure/slip fit so as to be disassemblied and assemblied again while pre-selected component parts of said pipe and fittings may be glued together said component parts have been pre-cut forming which forms a pre-selected part sequence order of assembly wherein said parts may have numbers or markings being used to assist with the assembly of said game.

15. The invention of claim 1 wherein the list of preferred and optional component parts and pipe measurements comprise in combination:

PREFERRED LIST two base means consisting of;

6 cap fittings; (or plus fittings)

6 pipe legs; said pipe each being approximately 12 inches in length;

2 three way tee fittings;

two post means consisting of;

6 pipe sections said pipe each being approximately 20 inches in length;

4 inside coupling fittings; (or outside couplings)

2 pointed post sections for outdoor use with a length of approximately 26 inches;

one horizontal support means consisting of;

2 elbow fittings;

2 pipe sections said pipe each being approximately 20 inches in length;

1 tee fitting;

one virtical net means with one loop eye at each opposing end said net having a cut length of approximately 60 inches and a finished length of approximately 48 inches;

one support means for a basketball backboard, hoop and net assembly consisting of;

a pipe nipple having a length of approximately 3 inches;

a cap fitting;

one attachment means for said support means to said basketball assembly means consisting of;

2 screws;

one basketball style assembly consisting of;

1 basketball style backboard;

2 basketball style hoops;

2 basketball style nets;

one attachment means for said basketball assembly consisting of;

2 bolts;

2 washers;

2 nuts;

OPTIONAL LIST:

one basketball style assembly consisting of;

1 basketball style hoop;

1 basketball style net; and 1 support frame means for said hoop and net; while said pipe and fittings are either 1¼ inch or 1½ inch in size with a schedule 40 strength.

* * * * *